US006751888B2

(12) United States Patent
Lueckenbach

(10) Patent No.: US 6,751,888 B2
(45) Date of Patent: Jun. 22, 2004

(54) CLOTHES DRYER ADAPTIVE HEATER CONTROL

(75) Inventor: William Henry Lueckenbach, Crestwood, KY (US)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 10/065,229

(22) Filed: Sep. 26, 2002

(65) Prior Publication Data

US 2004/0060196 A1 Apr. 1, 2004

(51) Int. Cl.[7] ..... F26B 11/02; F26B 3/00

(52) U.S. Cl. ..... 34/595; 34/606; 34/552; 34/486; 34/553; 34/491; 34/562

(58) Field of Search ..... 34/552, 595, 606, 34/486, 549, 553, 527, 562, 550, 491; 62/149, 176.6; 132/217; 236/51; 219/492; 116/216

(56) References Cited

U.S. PATENT DOCUMENTS 3,593,544 A * 7/1971 Hnederson ..... 68/12
4,842,192 A 6/1989 Range et al.
5,197,668 A * 3/1993 Ratz et al. ..... 236/51
5,224,536 A * 7/1993 Eigen et al. ..... 165/32
5,444,924 A * 8/1995 Joslin et al. ..... 34/486
5,570,520 A * 11/1996 Huffington ..... 34/535
5,673,497 A 10/1997 St. Louis
5,833,134 A * 11/1998 Ho et al. ..... 236/49.3
6,141,887 A 11/2000 Chen et al.
6,122,840 A1 9/2001 Chbat et al.

* cited by examiner

*Primary Examiner*—Kenneth B. Rinehart
(74) *Attorney, Agent, or Firm*—H. Neil Houser, Esq.; Armstrong Teasdale LLP

(57) ABSTRACT

A control system for a clothes dryer including a temperature sensor and a thermostat for regulating at least one dryer heating element is provided. The control system includes a microcomputer programmed to compensate for a conflict between the thermostat temperature regulation and the temperature sensor temperature regulation during dryer operation at a selected operating temperature.

20 Claims, 4 Drawing Sheets

CLOTHES DRYER ADAPTIVE HEATER CONTROL

BACKGROUND OF INVENTION

This invention relates generally to dryer systems, and, more particularly, to control systems for clothes dryers.

An appliance for drying articles such as a clothes dryer for drying clothing articles typically includes a cabinet including a rotating drum for tumbling clothes and laundry articles therein. One or more heating elements heats air prior to air entering the drum, and the warm air is circulated through the air as the clothes are tumbled to remove moisture from laundry articles in the drum. See, for example, U.S. Pat. No. 6,141,887.

Typically, such an appliance is operated for a set a drying time for drying the clothing articles therein. For the duration of the set time, the heating elements are activated and deactivated to maintain warm air circulation inside the drum, and for more accurate control of the dryer heating elements, a temperature sensor is sometimes used in conjunction with the heating elements. Rather than turning the heaters on and off for specified times, the heating elements can be operated more or less on demand for precise temperature control while minimizing energy consumption.

To prevent excessive temperatures in the drum, thermostat switches are also employed to deactivate the heating elements when the temperature of the circulated air reaches a predetermined threshold. A small heating element is sometimes placed adjacent the thermostat to provide a thermal bias. The provision of a thermal bias causes the thermostat to operate at a lower air temperature and is commonly used to lower the maximum exhaust air temperature at which the operating thermostat reacts. See, for example, U.S. Pat. No. 4,842,1 92.

It has been observed, however, that the thermostat switches can sometimes interfere with the temperature sensor control of the heating elements. Laundry loads, especially larger ones, may greatly restrict the airflow in the drum, which, in turn, may cause a safety thermostat to deactivate one or more of the dryer heaters before the temperature sensor indicates that the heaters should be deactivated. Thus, the thermostat prematurely deactivates the heaters and extends drying time, thereby negatively impacting dryer performance.

SUMMARY OF INVENTION

In one aspect, a control system for a clothes dryer including a temperature sensor and a thermostat for regulating at least one dryer heating element is provided. The control system comprises a microcomputer programmed to compensate for a conflict between the thermostat temperature regulation and the temperature sensor temperature regulation during dryer operation at a selected operating temperature.

In another aspect, a control system for regulating activation and deactivation of heating elements in a clothes dryer is provided. The control system comprises a temperature sensor in communication with a heated air source, a thermostat in communication with the heating air source and operatively coupled to the heating elements, and a microcomputer operatively coupled to said temperature sensor and to the dryer heating elements. The microcomputer is configured to compensate for premature deactivation of the heating elements during operation of the dryer.

In another aspect, a clothes dryer is provided. The dryer comprises a cabinet, a rotatable drum mounted in said cabinet, a drive system for rotating said drum, an air circulation system, a temperature sensor in communication with said air circulation system, a thermostat in communication with said air circulation system, and at least one heating element in communication with said air circulation system and operatively coupled to said thermostat. A controller is operatively coupled to said temperature sensor and to said heating element, and the controller is configured to activate and deactivate said heating element in response to an output from said temperature sensor to regulate air circulation temperature between an upper and lower bound. The controller is further configured to compensate for deactivation of said heater element before said upper bound has been reached.

In another aspect, a method of operating a clothes dryer including a microcomputer, a temperature sensor, and a thermostat for regulating a temperature of air circulating in the dryer is provided. The method comprises determining when the thermostat is interfering with temperature regulation via the temperature sensor, and adjusting setpoints of the temperature sensor when the thermostat is interfering with temperature regulation via the temperature sensor.

In still another aspect, a method of operating a clothes dryer is provided. The dryer includes a microcomputer, a temperature sensor, and a thermostat for regulating a temperature of air circulating in the dryer by activating and deactivating at least one heating element. The method comprises regulating activation of the heating element in response to temperature feedback from the temperature sensor, monitoring circulation air temperature over a period of time when the heating element is activated in response to feedback from the temperature sensor, determining whether the air circulation temperature decreases by a predetermined amount within the predetermined time, and adjusting an operating setpoint of the temperature sensor when the air circulation temperature decreases by the predetermined amount within the predetermined time.

DETAILED DESCRIPTION

Figure 1:
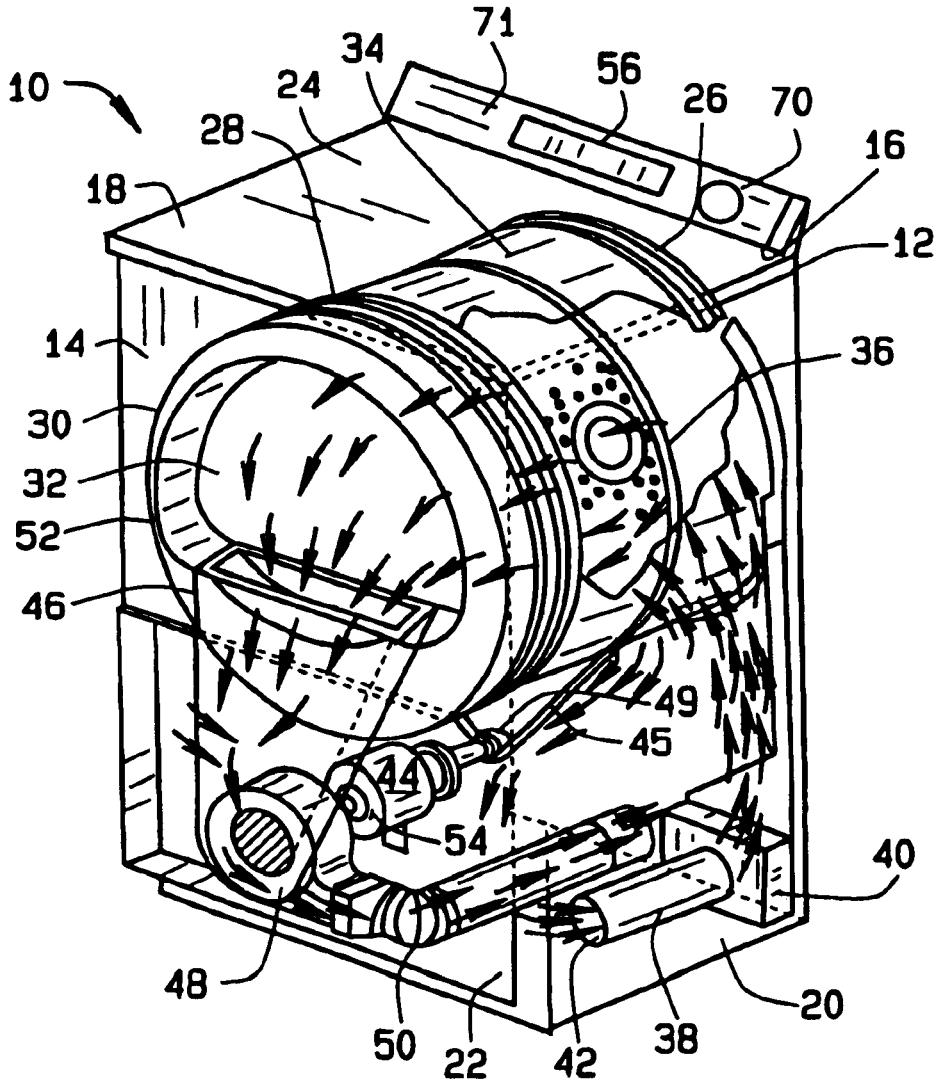
FIG. 1 is perspective broken away view of an exemplary dryer appliance.

FIG. 1 illustrates an exemplary clothes dryer appliance 10 in which the present invention may be practiced. While described in the context of a specific embodiment of dryer 10, it is recognized that the benefits of the invention may accrue to other types and embodiments of dryer appliances. Therefore, the following description is set forth for illustrative purposes only, and the invention is not intended to be limited in practice to a specific embodiment of dryer appliance, such as dryer 10.

Clothes dryer 10 includes a cabinet or a main housing 12 having a front panel 14, a rear panel 16, a pair of side panels 18 and 20 spaced apart from each other by the front and rear panels, a bottom panel 22, and a top cover 24. Within cabinet 12 is a drum or container 26 mounted for rotation around a substantially horizontal axis. A motor 44 rotates the drum 26 about the horizontal axis through a pulley 43 and a belt 45. The drum 26 is generally cylindrical in shape, having an imperforate outer cylindrical wall 28 and a front flange or wall 30 defining an opening 32 to the drum for loading and unloading of clothing articles and other fabrics.

A plurality of tumbling ribs (not shown) are provided within drum 26 to lift clothing articles therein and then allow them to tumble back to the bottom of drum 26 as the drum rotates. The drum 26 includes a rear wall 34 rotatably supported within the main housing 12 by a suitable fixed bearing. The rear wall 34 includes a plurality of holes 36 that receive hot air that has been heated by a heater such as a combustion chamber 38 and a rear duct 40. The combustion chamber 38 receives ambient air via an inlet 42. Although the clothes dryer 10 shown in FIG. 1 is a gas dryer, it could just as well be an electric dryer without the combustion chamber 38 and the rear duct 40. The heated air is drawn from the drum 26 by a blower fan 48 which is also driven by the motor 44. The air passes through a screen filter 46 which traps any lint particles. As the air passes through the screen filter 46, it enters a trap duct seal and is passed out of the clothes dryer through an exhaust duct 50. After the clothing articles have been dried, they are removed from the drum 26 via the opening 32.

A cycle selector knob 70 is mounted on a cabinet backsplash and is communication with a controller 56. Signals generated in controller 56 operate the drum drive system and heating elements in response to a position of selector knob 70.

Figure 2:
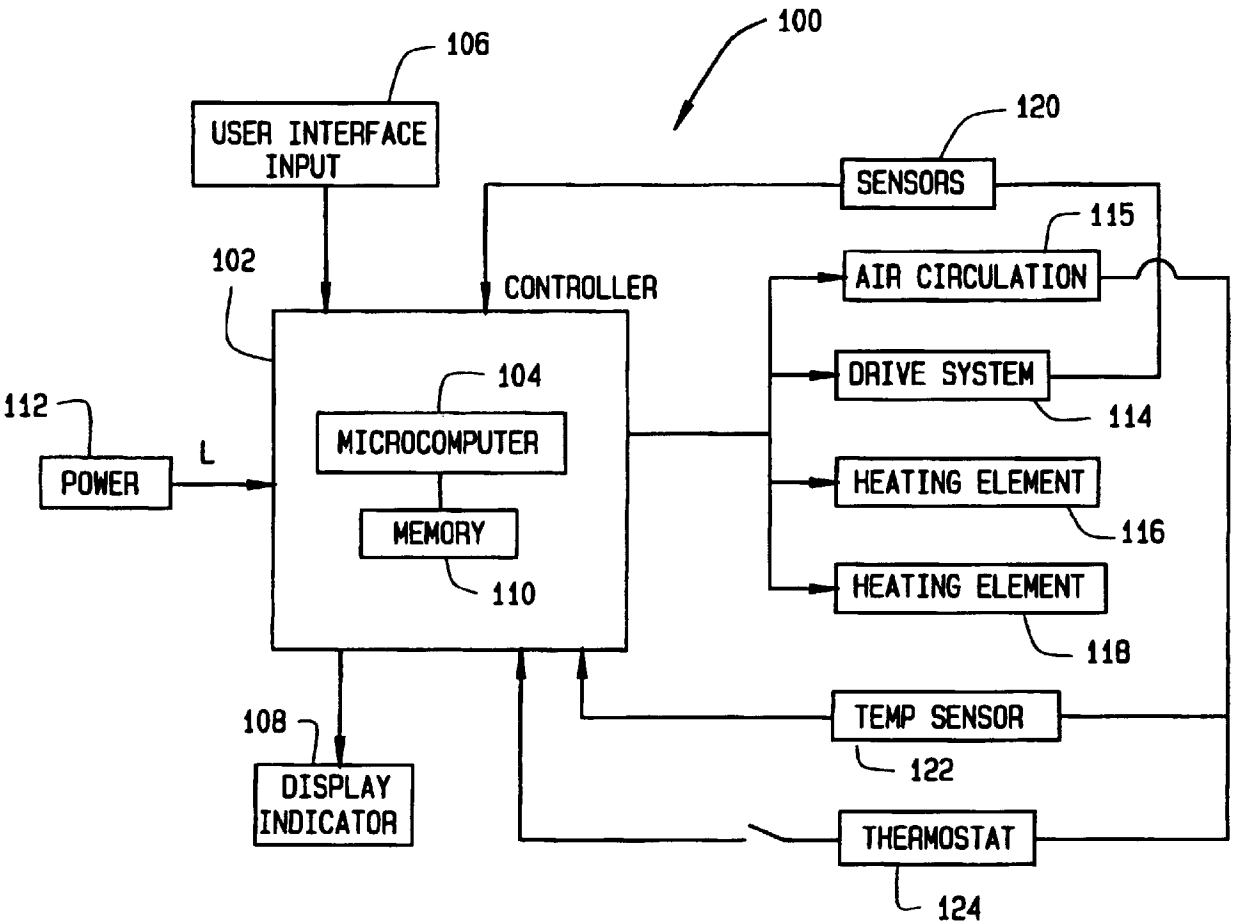
FIG. 2 is a schematic diagram of a control system for the appliance shown in FIG. 1.

FIG. 2 is a schematic diagram of an exemplary washing machine control system 100 for use with dryer 10 (shown in FIG. 1). Control system 100 includes controller 102 which may, for example, be a microcomputer 104 coupled to a user interface input 106 such as, for example, cycle selector knob 70 (shown in FIG. 1). An operator may enter instructions or select desired dryer cycles and features via user interface input 106 and in one embodiment a display or indicator 108 is coupled to microcomputers 104 to display appropriate messages and/or indicators, such as a timer, and other known items of interest to dyer users. A memory 110 is also coupled to microcomputer 104 and stores instructions, calibration constants, and other information as required to satisfactorily complete a selected dry cycle. Memory 110 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Power to control system 100 is supplied to controller 102 by a power supply 112 configured to be coupled to a power line L. Analog to digital and digital to analog converters (not shown) are coupled to controller 102 to implement controller inputs and executable instructions to generate controller output to dryer components such as those described above in relation to FIG. 1. More specifically, controller 102 is operatively coupled to machine drive system 114 (e.g., motor 44 shown in FIG. 1), an air circulation system 115 (e.g., blower fan 48) and drum heating elements 116, 118 according to known methods. While two heating elements 16, 118 are illustrated in FIG. 2, it is recognized that greater or fewer heaters may be employed within the scope of the present invention.

In response to manipulation of user interface input 106 controller 102 monitors various operational factors of dryer 10 with one or more sensors or transducers 120, and controller 102 executes operator selected functions and features according to known methods. Of course, controller 102 may be used to control drying machine system elements and to execute functions beyond those specifically described herein.

Heating elements 116, 118 are controlled by microcomputer 102 in response to outputs of a known temperature sensor 122 and are regulated by a known thermostat switch 124. Microcomputer 104 activates or deactivates heating elements 116, 118 to maintain a selected one of a plurality of heater settings corresponding to a selected dry cycle. In general, temperature sensor 122 is employed so that heating elements 116, 118 may be activated (i.e., energized in the case of electrical heating elements or ignited in the case of gas heating elements) to bring a temperature of the circulated air within drum 26 (shown in FIG. 1) to target levels corresponding to the selected heat setting. Thermostat 124 is employed to deactivate one or both of heating elements 116, 118 when air temperature exceeds predetermined limits.

While one temperature sensor 122 and one thermostat 124 are illustrated in FIG. 2, it is recognized that more than one temperature sensor and more than one thermostat may be employed in further and/or alternative embodiments of the invention. For example, a temperature sensor and/or a thermostat may be employed with each of heating elements 116, 118. Additionally, airflow temperature in an exemplary embodiment is sensed at an inlet of drum 26 (shown in FIG. 1), although it is appreciated that in alternative embodiments temperature may be sensed elsewhere, such as an outlet of the drum.

Temperature sensor 122 generally has a smaller hysteresis about an operating target temperature setpoint than thermostat 124. That is, the high temperature deactivation setpoint (i.e., a temperature above the target temperature wherein an associated heater is deactivated when temperature is rising) for the temperature sensor 122 is lower than the high temperature setpoint for the thermostat, and the low temperature activation setpoint (i.e., a temperature below the target temperature wherein an associated heater is activated when temperature is falling) for the temperature sensor 122 is higher than the low temperature setpoint for the thermostat 124. In other words, the temperature sensor 122 operates the heaters to maintain a tighter tolerance band about a target temperature than does thermostat 124.

The operating setpoints of temperature sensor 122 varies according to a selected heat level setting, and in one embodiment temperature sensor setpoint values are stored in memory 110 (shown in FIG. 2). Once a temperature setting is selected, microcomputer 104 selects the appropriate high temperature deactivation setpoint and the low temperature activation setpoint corresponding to the selected heat setting. High and low temperature setpoints for thermostat, however, are substantially constant and independent of the setpoint values for temperature sensor 122.

The larger hysteresis of the thermostat 124 sometimes presents a conflict with the smaller hysterisis of the temperature sensor 122 when the operating setpoints of the temperature sensor 122 and the thermostat 124 approach one another. For example, laundry loads, and especially larger loads, can severely change and restrict airflow into and through drum 26. At certain heater setpoints, the restricted airflow into the drum can cause the thermostat 124 to open and deactivate one or both of heaters 116, 118 before high temperature deactivation setpoint for the temperature sensor 122 is reached. As such, and as has been found to happen, the thermostat 124 can interrupt activation of one or both heaters 116, 118 before the temperature sensor 122 would call for deactivation of the heating elements 116, 118. Premature deactivation of heating elements 116, 118 via thermostat 124 in such circumstances lowers the average drum temperature for the dry cycle and therefore extends the time required for the cycle to be satisfactorily completed.

Figure 3:
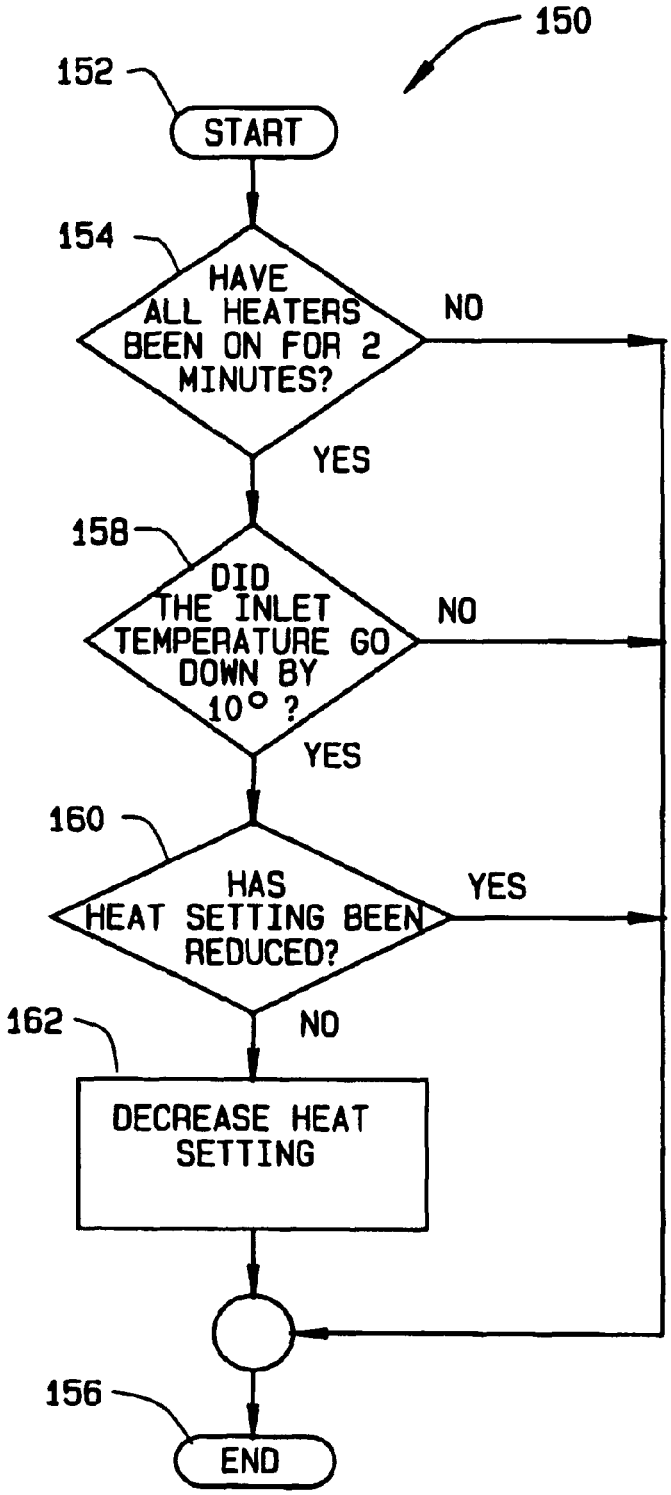
FIG. 3 is an adaptive heater control algorithm flowchart executable by the controller shown in FIG. 2.

FIG. 3 illustrates an adaptive heater control algorithm 150 executable by controller 102 (shown in FIG. 2) to address interference between thermostat 124 and temperature sensor 122 and to accordingly reduce drying cycle time. The algorithm determines whether there is a conflict between temperature sensor 124 (shown in FIG. 2) and thermostat 124 (shown in FIG. 2) and makes adjustments as necessary to minimize any conflicts that occur.

In an exemplary embodiment, algorithm 150 is called 152 once per second by microcomputer 104 (shown in FIG. 2) during operation of dyer 10 (shown in FIG. 1), although it is contemplated that algorithm 150 may be executed more frequently or less frequently in alternative embodiments.

Once algorithm 150 is begun 152, microcomputer 104 determines 154, based upon an output signal from temperature sensor 122, whether heating elements 116, 118 (shown in FIG. 2) should be activated to raise a temperature of circulated air in dryer 10. In other words, if the sensed temperature is less than the temperature sensor high deactivation setpoint for the current heat setting in the user selected dry cycle, microcomputer 104 outputs a signal to heating elements 116, 118 to activate the heaters and warm the circulated air. Controller 102 therefore determines 154 whether heating elements 116, 118 are set for activation for a predetermined amount of time or set for deactivation based upon a reading of temperature sensor 122. In the illustrated embodiment, controller 102 determines 154 whether heating elements 116, 118 have been set for activation for two minutes, although it is appreciated that in alternative embodiments other time periods may be used with equal effectiveness.

If controller 102 determines that heating elements 116, 118 have not been set for activation for the predetermined time period, algorithm 150 ends 156. If controller 102 determines that heating elements 116, 118 have been set for activation for the predetermined time period, then controller 102 determines 158 whether the air temperature has decreased by a specified amount based upon a reading from temperature sensor 122.

By determining whether air temperature actually decreased by the predetermined amount when heating elements 116, 118 are set for activation, controller 102 confirms whether heating elements 116, 118 are, in fact, activated and are producing heat. Further, by checking whether air temperature has been decreased by at least a predetermined amount, some temperature fluctuation due to uneven airflow through the dryer is tolerated. In an exemplary embodiment, the predetermined temperature decrease is about 10° F., although it is recognized that other temperature offset amounts may be employed in alternative embodiments without substantially affecting the invention.

If it is determined 158 that the air temperature has not decreased by more than the predetermined amount, algorithm 150 ends 156. If, however, it is determined that air temperature has decreased by the predetermined amount, it may be inferred that one or both of heater elements 116, 118 has been interrupted by thermostat 124 and are no longer producing heat. A conflict between thermostat 124 and temperature sensor 122 is therefore revealed, and controller 102 may take steps to compensate for this conflict and reconcile the competing functions of the temperature sensor 122 and the thermostat 124.

After determining 158 that air temperature has decreased by the predetermined amount, controller 102 determines 160 whether a heat setting for the current dry cycle has been reduced a predetermined number of times. By determining whether the heat setting has been reduced a predetermined number of times, overcompensation for conflicts between temperature sensor 122 and thermostat 124 may be avoided.

If controller 102 determines that the heat setting has been reduced a predetermined number of times, algorithm 150 ends 156. If controller 102 determines that the heat setting has not been reduced a predetermined number of times, controller 102 decreases 162 the heat setting to a lower level. As the heat setting is deceased, microcomputer 104 selects new operating setpoints from memory 110 corresponding to the next lowest power level setting. Thus, if controller 102 is operating heating elements at a heat setting of n corresponding to temperature sensor high and low setpoints of $T_{H(n)}$ and $T_{L(n)}$ respectively before the heat setting is decreased 156, then controller 102 decreases the heat setting to a setting (n−1) corresponding to temperature sensor high and low setpoints of $T_{H(n-1)}$ and $T_{L(n-1)}$. For example, a power level setting of 5 is decreased to a power level setting of 4 and the temperature sensor setpoints are reset to correspond to the decreased heat setting.

By decreasing 162 the heat level setting, the high temperature setpoint of temperature sensor 122 is reduced to a lower level that presents less of a conflict, and hopefully no conflict with thermostat 124. Therefore, interruption of the heating elements 116, 118 by thermostat 124 may be substantially avoided and drying may continue with heating elements 116, 118 activated at a slightly lower setting. Downtime wherein heating elements are inactive is therefore substantially minimized. In most cases, the temperature sensor high temperature setpoint is reduced to a point below the thermostat high temperature setpoint at the reduced heat setting so that temperature regulation is governed solely by temperature sensor 122. As such, temperature regulation is maintained about a tighter tolerance band with the heating elements activated to maintain circulated air temperature in dryer 10. Average drum temperature is therefore increased relative to the higher heat setting wherein thermostat 124 would otherwise interrupt activation of heating elements 116, 118. Accordingly, drying time is reduced due to the compensated heat setting.

When the heat setting is decreased 162, a flag is set in controller memory 110 so that microcomputer 104 can verify whether the heat setting has been reduced a predetermined number of times in a given dry cycle. Controller 102 determines 160 whether the heat setting has been reduced by checking a state of this flag. After the heat setting has been decreased 162 a predetermined number of times, algorithm 160 ends in subsequent iterations of the algorithm.

In an exemplary embodiment, the predetermined number of times used to determine 160 whether the heat setting decrease 162 is permissible is one. Decreasing the heat setting only once per dry cycle is believed to be advantageous because if the heat setting is decreased further, the required time to satisfactorily complete a drying cycle will be inevitably increased due to the lower temperature of the circulated air. It is contemplated, however, that in alternative embodiments, the predetermined number of times that the heat setting is reduced may be greater than one, especially when a large number of heat settings are accommodated and the degree of change between heat settings is small.

Figure 4:
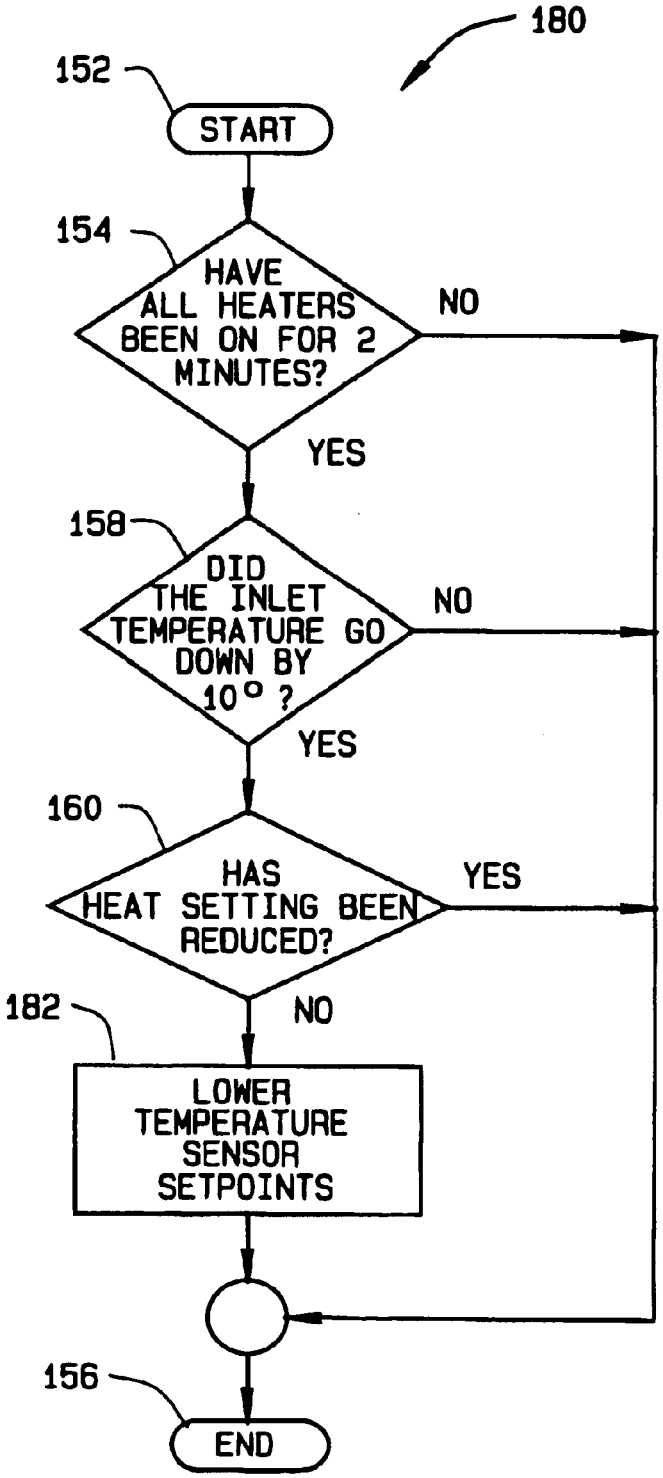
FIG. 4 is another embodiment of an adaptive heater control algorithm flowchart executable by the controller shown in FIG. 2.

FIG. 4 illustrates another embodiment of an adaptive heater control algorithm 180 executable by controller 102 (shown in FIG. 2). Algorithm 180 functions substantially similar to algorithm 150 (described above in relation to FIG. 4) except as noted below. Like reference characters of algorithm 150 are therefore used with like features of algorithm 180 where applicable in FIG. 4.

Unlike algorithm 150 (shown in FIG. 3) which decreases a heat setting of the current dryer cycle to compensate for temperature sensor/thermostat conflicts, algorithm 180 lowers 182 setpoints of temperature sensor 122 in an attempt to bring the temperature sensor high temperature setpoint to a point below the thermostat high temperature setpoint. Temperature setpoints may be lowered 182, for example, by a predetermined temperature offset stored in controller memory 110 or by a calculated or determined amount in response to specific operating conditions. Also, in a further embodiment, controller 102 could make a direct comparison between current temperature sensor setpoints and thermostat set points to ensure that thermostat 124 does not interfere with temperature sensor 122 and prematurely deactivate heater elements 116, 118.

By eliminating adjustment of heat level settings as in algorithm 150 and by directly adjusting temperature sensor setpoints, algorithm 180 is more amenable to dryer systems with a small number of heat settings, or even a single heat setting.

Either algorithm 150 or algorithm 180 facilitates adaptive dryer control to changing dryer conditions. As load sizes vary, compensation for conflicts between thermostat 124 and temperature sensor 122 are made as necessary, and when no conflict is presented, no adjustments are made to dryer cycles. Extended dryer cycles due to deactivation of the dryer heating elements are avoided and dryer performance is accordingly improved.

It is believed that those in the art of electronic controllers could build and program a controller to execute the above-described algorithms without further explanation.

While the invention has been described in terms of various specific embodiments, those skilled in the art will recognize that the invention can be practiced with modification within the spirit and scope of the claims.

What is claimed is:

1. A control system for a clothes dryer including a temperature sensor and a thermostat for regulating at least one dryer heating element, said control system comprising a microcomputer programmed to compensate for a conflict between the thermostat temperature regulation and the temperature sensor temperature regulation during dryer operation at a selected operating temperature and to adjust a set point of the temperature sensor.

2. A control system in accordance with claim 1 wherein said microcomputer is programmed to compensate if a sensed temperature from the temperature sensor has decreased by a predetermined amount.

3. A control system for a clothes dryer including a temperature sensor and a thermostat for regulating at least one dryer heating element, said control system comprising a microcomputer programmed to compensate for a conflict between the thermostat temperature regulation and the temperature sensor temperature regulation during dryer operation at a selected operating temperature, wherein said microcomputer is programmed to compensate if a sensed temperature from the temperature sensor has decreased by a predetermined amount over a predetermined time period when, according to a reading of the temperature sensor, the heating elements should be activated to raise a temperature of circulated air.

4. A control system for a clothes dryer including a temperature sensor and a thermostat for regulating at least one dryer heating element, said control system comprising a microcomputer programmed to compensate for a conflict between the thermostat temperature regulation and the temperature sensor temperature regulation during dryer operation at a selected operating temperature, wherein the dryer operates at the selected temperature according to a heat setting, said microcomputer is programmed to reduce the heat setting when the thermostat temperature regulation is in conflict with the temperature sensor temperature regulation.

5. A control system for a clothes dryer including a temperature sensor and a thermostat for regulating at least one dryer heating element, said control system comprising a microcomputer programmed to compensate for a conflict between the thermostat temperature regulation and the temperature sensor temperature regulation during dryer operation at a selected operating temperature, said microcomputer programmed to reduce a high temperature setpoint of the temperature sensor when the thermostat temperature regulation is in conflict with the temperature sensor temperature regulation.

6. A control system for regulating activation and deactivation of heating elements in a clothes dryer, said control system comprising:

a temperature sensor in communication with a heated air source;

a thermostat in communication with the heating air source and operatively coupled to the heating elements; and a microcomputer operatively coupled to said temperature sensor and to the dryer heating elements, said microcomputer configured to adjust a set point of said temperature sensor to compensate for premature deactivation of the heating elements during operation of the dryer.

7. A control system for regulating activation and deactivation of heating elements in a clothes dryer, said control system comprising:

a temperature sensor in communication with a heated air source;

a thermostat in communication with the heating air source and operatively coupled to the heating elements; and a microcomputer operatively coupled to said temperature sensor and to the dryer heating elements, said microcomputer configured to adjust a setpoint of said temperature sensor to compensate for premature deactivation of the heating elements during operation of the dryer.

8. A control system for regulating activation and deactivation of heating elements in a clothes dryer, said control system comprising:

a temperature sensor in communication with a heated air source;

a thermostat in communication with the heating air source and operatively coupled to the heating elements; and a microcomputer operatively coupled to said temperature sensor and to the dryer heating elements, said microcomputer configured to compensate for premature deactivation of the healing elements during operation of the dryer and to adjust a heat setting during operation of the dryer to compensate for premature deactivation of the heating elements.

9. A control system for regulating activation and deactivation of heating elements in a clothes dryer, said control system comprising:

a temperature sensor in communication with a heated air source;

a thermostat in communication with the beating air source and operatively coupled to the heating elements; and a microcomputer operatively coupled to said temperature sensor and to the dryer heating elements, said microcomputer configured to compensate for premature deactivation of the heating elements during operation of the dryer, wherein said microcomputer is configured to determine whether actual air temperature is decreasing when, based upon a reading from said temperature sensor, the heating elements should be activated.

10. A control system in accordance with claim 9 wherein said microcomputer is configured to monitor actual air temperature over a predetermined time period to determined whether said thermostat is interfering with temperature regulation via said temperature sensor.

11. A clothes dryer comprising:

a cabinet;

a rotatable drum mounted in said cabinet;

a drive system for rotating said drum;

an air circulation system;

a temperature sensor in communication with said air circulation system;

a thermostat in communication with said air circulation system;

at least one heating element in communication with said air circulation system and operatively coupled to said thermostat; and a controller operatively coupled to said temperature sensor and to said heating element, said controller configured to activate and deactivate said heating clement in response to an output from said temperature sensor to regulate air circulation temperature between an upper and lower bound, said controller further configured to adjust a set point of said temperature sensor to compensate for deactivation of said heater element before said upper bound has been reached.

12. A clothes dryer comprising:

a cabinet;

a rotatable drum mounted in said cabinet;

a drive system for rotating said drum;

an air circulation system;

temperature sensor in communication with said air circulation system;

a thermostat in communication with said air circulation system;

at least one heating element in communication with said air circulation system and operatively coupled to said thermostat; and a controller operatively coupled to said temperature sensor and to said heating element, said controller configured to activate and deactivate said heating element in response to an output from said temperature sensor to regulate air circulation temperature between an upper and lower bound, said controller further configured to compensate for deactivation of said heater element before said upper bound has been reached, wherein said controller comprises a microcomputer, said microcomputer programmed to activate said heater when air circulation temperature falls below said lower bound.

13. A clothes dryer in accordance with claim 12 wherein said microcomputer is programmed to monitors circulation air temperature for a predetermined time period after said healer is activated.

14. A clothes dryer in accordance with claim 13 wherein said compensation is enabled if air circulation temperature has decreased by a predetermined amount within said predetermined time period.

15. A clothes dryer comprising:

a cabinet;

a rotatable drum mounted in said cabinet;

a drive system for rotating said drum;

an air circulation system;

a temperature sensor in communication with said air circulation system;

a thermostat in communication with said air circulation system;

at least one heating element in communication with said air circulation system and operatively coupled to said thermostat; and a controller operatively coupled to said temperature sensor and to said heating element, said controller configured to activate and deactivate said heating element in response to an output from said temperature sensor to regulate air circulation temperature between an upper and lower bound, said controller further configured to compensate for deactivation of said heater element before said upper bound has been reached, wherein said controller is programmed to adjust said upper bound when said thermostat deactivates said heater element before said upper bound has been reached.

16. A clothes dryer comprising:

a cabinet;

a rotatable drum mounted in said cabinet;

a drive system for rotating said drum;

an air circulation system;

a temperature sensor in communication with said air circulation system;

a thermostat in communication with said air circulation system;

at least one heating element in communication with said air circulation system and operatively coupled to said thermostat; and a controller operatively coupled to said temperature sensor and to said heating element, said controller configured to activate and deactivate said heating element in response to an output from said temperature sensor to regulate air circulation temperature between an upper and lower bound, said controller further is configured to compensate for deactivation of said heater element before said upper bound has been reached only for a designated number of times per dryer cycle.

17. A method of operating a clothes dryer including a microcomputer, a temperature sensor, and a thermostat for regulating a temperature of air circulating in the dryer, said method comprising:

determining when the thermostat is interfering with temperature regulation via the temperature sensor; and adjusting setpoints of the temperature sensor when the thermostat is interfering with temperature regulation via the temperature sensor.

18. A method in accordance with claim 17 wherein said adjusting setpoints of the temperature sensor comprises reducing a heat level setting.

19. A method in accordance with claim 17 further comprising determining whether air circulation temperature has decreased by a predetermined amount over a predetermined time period.

20. A method of operating a clothes dryer including a microcomputer, a temperature sensor, and a thermostat for regulating a temperature of air circulating in the dryer by activating and deactivating at least one heating element, said method comprising:

regulating activation of the heating element in response to temperature feedback from the temperature sensor;

monitoring circulation air temperature over a period of time when the heating element is activated in response to feedback from the temperature sensor;

determining whether the air circulation temperature decreases by a predetermined amount within the predetermined time; and adjusting an operating setpoint of the temperature sensor when the air circulation temperature decreases by the predetermined amount within the predetermined time.

* * * * *

UNITED STATES PATENT AND TRADEMARK OFFICE

CERTIFICATE OF CORRECTION

PATENT NO. : 6,751,888 B2
DATED : June 22, 2004
INVENTOR(S) : William Henry Lueckenbach It is certified that error appears in the above-identified patent and that said Letters Patent is hereby corrected as shown below:

Column 8,
Line 61, delete “healing” and insert -- heating --.

Column 9,
Line 3, delete “beating” and insert -- heating --.
Line 15, delete “determined” and insert -- determine --.
Line 33, delete “clement” and insert -- element --.
Line 45, before “temperature” insert -- a --.
Line 67, delete “healer” and insert -- heater --.

Signed and Sealed this

Thirtieth Day of May, 2006

JON W. DUDAS
*Director of the United States Patent and Trademark Office*